United States Patent [19]

Lahoda et al.

[11] 4,318,786

[45] Mar. 9, 1982

[54] ELECTROLYTIC DECONTAMINATION

[75] Inventors: Edward J. Lahoda, Edgewood; David A. Eckhardt, Penn Hills, both of Pa.; Donald L. Grover, Richland, Wash.

[73] Assignee: Westinghouse Electric Corp., Pittsburgh, Pa.

[21] Appl. No.: 128,771

[22] Filed: Mar. 10, 1980

[51] Int. Cl.[3] ..... C25F 1/04; C25F 3/14; C25F 5/00

[52] U.S. Cl. ..... 204/141.5; 204/29.5; 204/129.6; 204/224 R

[58] Field of Search ..... 204/129.5, 129.6, 141.5, 204/224 R

[56] References Cited

U.S. PATENT DOCUMENTS

| | | | |
|---|---|---|---|
| 3,048,528 | 8/1962 | Covington | 204/224 R |
| 3,202,598 | 8/1965 | Covington | 204/129.5 |
| 3,326,785 | 6/1967 | Williams | 204/129.5 |
| 4,082,638 | 4/1978 | Jumer | 204/224 R |

FOREIGN PATENT DOCUMENTS

| | | | |
|---|---|---|---|
| 136982 | 8/1979 | German Democratic Rep. | 204/141.5 |

OTHER PUBLICATIONS

Official Gazette, vol. 673, p. 836, Aug. 18, 1953.

*Primary Examiner*—T. M. Tufariello

*Attorney, Agent, or Firm*—L. A. DePaul; Z. L. Dermer

[57] ABSTRACT

The invention comprises methods and apparatus for conducting a stream of electrolyte solution with an electrical potential applied between the nozzle of the apparatus and the piece of equipment to be decontaminated. The apparatus provides a nozzle that is capable of conducting the electrolyte to the component to be decontaminated in an effective manner without short circuiting the electrical system. Moreover, the method provides a means by which the exposure time of the component to the electrolyte is controlled such that corrosion of the component is minimized while the component is effectively decontaminated.

10 Claims, 4 Drawing Figures

ELECTROLYTIC DECONTAMINATION

CROSS-REFERENCE TO RELATED APPLICATIONS

This application is related to application Ser. No. 063,324, filed Aug. 2, 1979 in the name of T. A. Wojcik et al. and entitled "Decontamination Apparatus"; application Ser. No. 029,598, filed Apr. 12, 1979 in the name of R. T. Marchese and entitled "Decontamination Method"; and application Ser. No. 085,444, filed Oct. 16, 1979 in the name of E. H. Smith et al. and entitled "Decontamination Apparatus", all of which are assigned to the Westinghouse Electric Corporation.

BACKGROUND OF THE INVENTION

This invention relates to decontamination apparatus and methods and more particularly to electrolytic decontamination methods.

A major problem encountered in performing maintenance on nuclear power plant equipment is the radiation exposure of maintenance personnel. Since the coolant that circulates through the nuclear reactor system is exposed to radiation, the coolant carries the radiation through most of the components of the nuclear reactor system. This circulation of the coolant through the nuclear reactor system causes many of the components of the nuclear reactor to become radioactive. Occasionally, over the life of the nuclear power plant, certain of the components of the nuclear power plant system need to have maintenance performed on them. When it is necessary to perform maintenance of these components, it is sometimes necessary for maintenance personnel to come in close contact with these components. Since the components are radioactive, great care must be taken by the working personnel to avoid over exposure from this radiation. When the operations to be performed on these components requires a great deal of time, the radiation field associated with the contaminated components poses great difficulty in performing these operations because of the limited time in which any particular working personnel may be allowed to be present near the component. Under certain circumstances the radiation field of the component may greatly extend the time to perform the maintenance and it may also greatly increase the number of working personnel needed to perform the task because each of the personnel may only be present near the component for a limited amount of time. Therefore, it has become necessary to develop techniques for reducing the radiation field associated with these components so that working personnel may be present near the components for a greater length of time so as to be able to perform the maintenance procedures in an expedient manner.

It has been known that the radiation field associated with these components is produced by a thin layer of radioactive oxide films that have become deposited on the inside surfaces of these components. Methods for reducing the radioactive field associated with these components have centered on removing this radioactive metal oxide film without damaging the component. Methods which have been tried to remove this metal oxide film include sandblasting, rinsing the components with solutions to remove the film, and wiping of the surface of the component to remove the oxide film. Difficulties which arise with some of these methods include the inability to easily clean the rough surface of some types of components, the airborne radiation caused by removing the oxide film such as in sandblasting, and possible contamination of the primary or secondary side cooling water by residual materials from these methods. Therefore, what is needed is a system for decontaminating components of nuclear power plants so that maintenance may be performed thereon without damaging the component or spreading the contaminants throughout the reactor system.

SUMMARY OF THE INVENTION

The invention comprises methods and apparatus for conducting a stream of electrolyte solution with an electrical potential applied between the nozzle of the apparatus and the piece of equipment to be decontaminated. The apparatus provides a nozzle that is capable of conducting the electrolyte to the component to be decontaminated in an effective manner without short circuiting the electrical system. Moreover, the method provides a means by which the exposure time of the component to the electrolyte is controlled such that corrosion of the component is minimized while the component is effectively decontaminated.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

In nuclear power plant systems, it is occasionally necessary to inspect or repair various components of the system. Before inspection or repair can be made it is sometimes advisable to decontaminate the components so as to reduce the radiation field associated with the component. The invention described herein provides a means by which the radiation field of the component may be reduced so that working personnel may effectively perform maintenance or inspection operations on the component.

Figure 1:
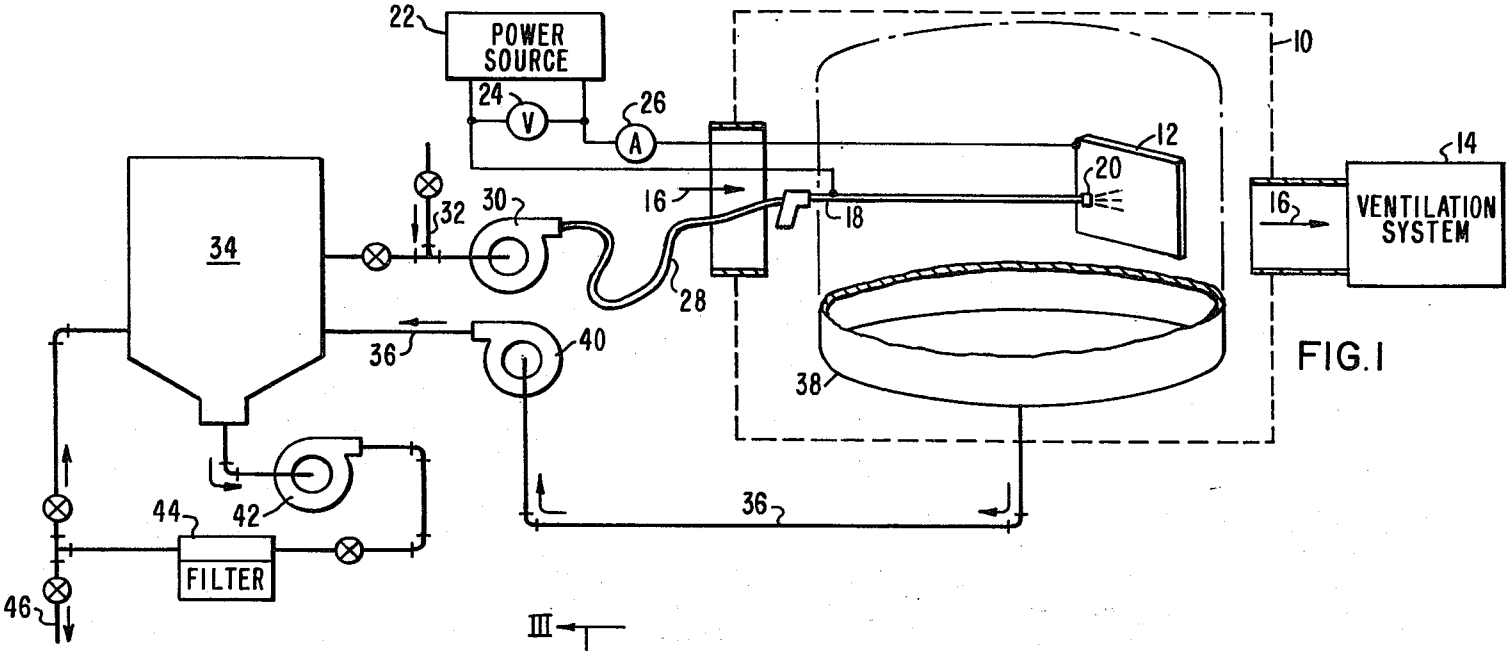
FIG. 1 is a schematic diagram of the decontamination system.

Referring to FIG. 1, the decontamination system comprises an enclosure 10 which may surround the component 12 that is to be decontaminated. Of course, the component 12 may be a component such as a nuclear steam generator in which the enclosure 10 comprises the housing of the nuclear steam generator. Enclosure 10 serves to prevent the loosened contamination from being spread throughout the nuclear power plant system. In addition, a ventilation system 14 may be attached to enclosure 10 so as to draw air through enclosure 10 in the direction of arrow 16 such as to remove all loose airborne contaminants and to recover those contaminants in ventilation system 14. In this manner, the area surrounding the component to be decontaminated can be free of airborne contaminants. The apparatus also comprises a wand 18 having a nozzle 20 on the end thereof. Wand 18 may be a hand-held wand or it may be and automatic arm such as that disclosed in copending application Ser. No. 063,324, filed Aug. 2, 1979 in the name of T. A. Wojcik et al. and entitled "Decontamination Apparatus" which is assigned to the assignee of the present application. Wand 18 provides a means by which the electrolyte can be directed over the entire component to be decontaminated. Wand 18 is electrically connected to a power source 22 which may be a DC power source capable of 20 amperes at 40 volts DC. Power source 22 is also connected to component 12 so that when the electrolyte is conducted from wand 18 to component 12 an electrical circuit is completed between wand 18, the electrolyte, the component 12, and power source 22 as shown in FIG. 1. A voltmeter 24 and an ammeter 26 are also connected between wand 18 and power source 22 so as to be able to determine the voltage and current of the electrical system. A flexible rubber hose 28 is connected between wand 18 and first pump 30. Hose 28 provides a means by which the electrolyte can be conducted to wand 18 while allowing the flexibility of moving wand 18 so as to reach the entire area of component 12. First pump 30 may be a 0.5 Hp centrifugal pump for pumping the electrolyte through hose 28 and through wand 18 thereby contacting component 12 in an effective manner. The first conduit 32 is provided for conducting water from a main water supply into the system. First pump 30 is connected to electrolyte feedtank 34 which serves as a collection means for the electrolyte that is being recirculated through the system. A second conduit 36 is connected between a collection vessel 38 which is disposed within enclosure 10 for collecting the electrolyte that has contacted component 12. From collection vessel 38 the electrolyte flows through second conduit 36 by either a gravity flow system or by means of a second pump 40 which may be a 0.5 Hp positive displacement pump. From second conduit 36 the electrolyte is returned to electrolyte feedtank 34 thereby enabling the electrolyte to be recirculated through the system. A third pump 42 is connected to electrolyte feedtank 34 for circulating the electrolyte solution through a recirculation system. The recirculation system comprises an absolute filter 44 which may be a cartridge filter and a liquid disposal line 46. Filter 44 serves to remove contaminants from the system and to consolidate those contaminants while liquid disposal line 46 is provided to drain off excess liquid from the system. From filter 44 the electrolyte solution is recirculated back to the electrolyte feedtank 34 so that it may be again circulated through the decontamination system. The system is also provided with a number of valves as shown in FIG. 1 for controlling the flow of the electrolyte solution through the system.

Figure 4:
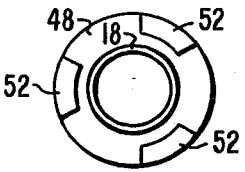
FIG. 4 is an end view of an alternate design for the nozzle.
Figure 3:
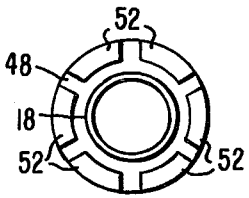
FIG. 3 is a view along line III—III of FIG. 2.
Figure 2:
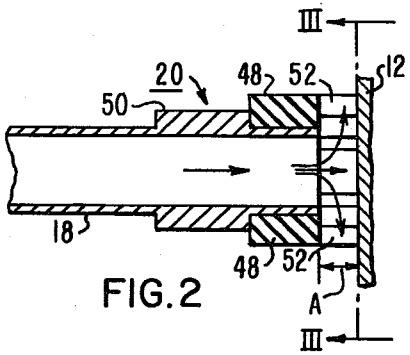
FIG. 2 is a cross-sectional view of the nozzle for the decontamination system.

Referring now to FIG. 2, nozzle 20 comprises a hard rubber insulator 48 mounted on the end of wand 18. The end of wand 18 may be a stainless steel tube having a bore approximately 0.30 inches in diameter for conducting the electrolyte solution therethrough and toward component 12. Wand 18 may be provided with a stop 50 mounted on or integral with wand 18 so as to provide a mounting for insulator 48. Insulator 48 is mounted on wand 18 so that the end of wand 18 is maintained between about 0.128 to 0.375 inches and preferably approximately 0.25 inches from component 12 as indicated by distance A in FIG. 2. The spacing between the end of wand 18 and the component 12 is maintained so that wand 18 does not contact component 12 thereby preventing short circuiting of the electrical circuit. In addition, insulator 48 provides a means by which the operator or mechanism that is holding wand 18 may allow insulator 48 to contact component 12 while maintaining a fixed distance between wand 18 and component 12 without short circuiting the system. In this manner, a fixed distance can be maintained between wand 18 and component 12 so that the flow of electrolyte can be determined. Insulator 48 is constructed such that its outside diameter is approximately 1 inch. Insulator 48 is also constructed to have radial extensions 52 on the end thereof so as to maintain contact between insulator 48 and component 12 while also allowing the electrolyte to be conducted from wand 18 and through insulator 48 as shown in the drawings. Depending on the flow characteristics that are desired, insulator 48 may be constructed as shown in FIG. 3, or to achieve a greater flow of electrolyte insulator 48 may be constructed as shown in FIG. 4.

An important aspect of an electrolytic decontamination system is the type of electrolyte used. The important criteria to be considered in selecting an appropriate electrolyte are (1) conductivity; (2) cost; (3) toxicity; (4) stability; and (5) corrosiveness. Selecting an electrolyte which optimizes these five criteria will greatly enhance the success of the electrolytic decontamination process.

It has been found that a 10 weight percent sulfuric acid solution provides a high degree of conductivity, a low cost, and can be handled easily. Therefore, the solution of water and 10 percent sulfuric acid by weight provides an electrolyte which can be used in the decontamination system as described herein with satisfactory results. Other electrolyte solutions which have been suggested for use in electrolytic decontamination systems are ammonium citrate, ammoniated EDTA, ammonium oxylate, chromic acid, phosphoric acid, citric acid, oxylic acid, boric acid, and ENDOX 214. The sulfuric acid electrolyte has a relatively high conductivity in comparison with these other electrolytes. For a given set of nozzle conditions and applied potential, the sulfuric acid electrolyte conducts more current than these other electrolytes. The advantage in using a high conductivity electrolyte is the high rate of oxide removal which may be obtained. The disadvantage with a high conductivity electrolyte is that the fast oxide removal rate can result in overexposure of the surface which may lead to unwanted attack on the component structure. In order to prevent overexposure of the surface of the component to the high conductivity electrolyte, corrosion inhibitors can be added to the solution or strict control of the exposure time of the component to the electrolyte can be had.

It has been found that the addition of corrosion inhibitors such as 1-ethylquinolinium iodide at the rate of 1 gram per liter of solution and benzotriazole at the rate of 0.1 gram per liter of solution does not appreciable affect the conductivity of the sulfuric acid solution.

Since the thin oxide film of contaminants on the component generally has a thickness of approximately 0.001 millimeters, it is important to limit the metal removal to approximately 0.001 to 0.002 millimeters in order to remove the oxide film without damaging the component. In general, it is thought that the amount of metal removed should not exceed 0.005 millimeters so as to prevent pitting of the component surface which may lead to greater corrosive attack in the future. It has been found that with the use of the system as described herein the component may be exposed to the electrolyte solution for approximately 4 to 5 seconds without having a detrimental effect on the component surface. Preferably, the exposure time of the electrolyte to the surface of the component should be limited to approximately 1 second under the conditions as described herein. It has been found that the preferred method of decontaminating a component using the electrolytic decontamination process as described herein is to have wand 18 spaced approximately 0.25 inches from the component by means of insulator 48 so that a solid stream of electrolyte can be established at approximately 6 psi at the nozzle. Under these conditions the electrolyte has a current capacity of between approximately 3 and 20 amperes and preferably approximately 16 amperes and a flow rate of approximately 3 gallons per minute (12.5 feet per second). At this rate the solid stream nozzle can cover an area of approximately $7.6\times10^{-4}$ square feet at one location. The electrical potential between the end of wand 18 and the component to be decontaminated should be maintained between approximately 30 to 50 volts and preferably at approximately 40 volts. These parameters should be established for the use of an electrolyte solution containing sulfuric acid at 10 percent by weight and at a pH maintained below 9. Under these conditions a cleaning rate can be had of approximately $1.4\times10^{-3}$ $ft^2/sec$. Therefore, it can be seen that the invention provides an electrolytic decontamination method wherein a component can be decontaminated at a relatively quick rate without exposing the metal surface to excessive deterioration.

We claim as our invention:

1. A method for electrolytically decontaminating components comprising:

arranging a wand near the component to be decontaminated for conducting an electrolyte solution to said component;

maintaining the end of said wand approximately 0.20 to 0.30 inches from the surface of said component;

conducting said electrolyte solution through said wand and onto said component;

conducting an electrical current from said wand, through said electrolyte solution, and through said component; and moving said wand along said component so that no portion of said component is exposed to said electrolyte solution for more than approximately 5 seconds for removing the contaminated oxide layer from said component without damaging the metal surface of said component.

2. The method according to claim 1 wherein the surfaces of said component are exposed to said electrolyte solution for approximately 1 second.

3. The method according to claim 2 wherein said electrolyte solution is a solution of water having approximately 10 percent sulfuric acid by weight.

4. The method according to claim 3 wherein said electrical current is established between approximately 3 to 20 amperes.

5. The method according to claim 4 wherein an electrical potential of between approximately 30 to 50 volts is maintained between said wand and said component.

6. The method according to claim 5 wherein said electrolyte solution is conducted through said wand at approximately 3 gallons per minute.

7. The method according to claim 6 wherein said electrolyte solution is conducted through said wand at approximately 6 psi.

8. The method according to claim 7 wherein said wand has a rubber insulator mounted on the end thereof.

9. The method according to claim 8 wherein said electrical current is established at approximately 16 amperes.

10. The method according to claim 9 wherein said electrical potential of approximately 40 volts is maintained between said wand and said component.

* * * * *